US006772922B2

(12) United States Patent
Renard et al.

(10) Patent No.: US 6,772,922 B2
(45) Date of Patent: Aug. 10, 2004

(54) ONE-PIECE INNER NOZZLE AND CLAMPING DEVICE FOR HOLDING SUCH A NOZZLE

(75) Inventors: Jean-luc Renard, Saint-Symphorien (BE); Vincent Boisdequin, Naast (BE); Calogero Lattuca, Brussels (BE); Mariano Collura, Stropy-Bracquegnies (BE)

(73) Assignee: Vesuvius Crucible Company, Wilmington, DE (US)

( * ) Notice: Subject to any disclaimer, the term of this patent is extended or adjusted under 35 U.S.C. 154(b) by 52 days.

(21) Appl. No.: 10/257,744

(22) PCT Filed: Apr. 20, 2001

(86) PCT No.: PCT/BE01/00069

§ 371 (c)(1),
(2), (4) Date: Oct. 16, 2002

(87) PCT Pub. No.: WO01/81028

PCT Pub. Date: Nov. 1, 2001

(65) Prior Publication Data

US 2003/0102611 A1 Jun. 5, 2003

(30) Foreign Application Priority Data

Apr. 21, 2000 (EP) ..... 00870078

(51) Int. Cl.[7] ..... B22D 41/08
(52) U.S. Cl. ..... 222/600; 222/606; 164/437
(58) Field of Search ..... 222/606, 600, 222/607; 164/437, 435, 335

(56) References Cited

U.S. PATENT DOCUMENTS 4,526,304 A 7/1985 Nishimura
4,573,616 A 3/1986 Shapland
4,840,296 A * 6/1989 Otsuka et al. ..... 222/600
5,044,533 A 9/1991 King
5,251,794 A * 10/1993 Toaldo ..... 222/600

FOREIGN PATENT DOCUMENTS

EP 0819489 A2 1/1998
FR 2707190 A3 1/1995
WO WO 8806500 A1 9/1988

* cited by examiner

*Primary Examiner*—Scott Kastler
(74) *Attorney, Agent, or Firm*—James R. Williams; Robert S. Klemz, Jr.

(57) ABSTRACT

The present invention relates to a clamping device including at least two assemblies each composed of a clamp (10) pivoting about a horizontal axis (11) and fitted with a groove (12) receiving a shoe (13) generally cylindrical in shape incorporating a flat surface (14) parallel to the axis of said cylinder, said shoe being capable of pivoting in the groove.

The present invention also relates to a one-piece inner nozzle (2) particularly adapted for use with this clamping device. The one-piece inner nozzle according to the invention is thus composed of a tubular part (6) defining a pouring channel (4) and a flat part or plate (7) providing contact with the downstream component (8) of the pouring channel. The characteristic of the nozzle according to the invention is that the plate (7) is generally shaped as a prism which can be defined by its polygon-shaped bases and the prismatic surface which they intersect perpendicularly, the said polygonal bases comprising an upper base (22), whose displacement within the prismatic surface defines the interface with the tubular part (6) and a lower base (21) parallel to the upper base and, on either side of the upper base, two sides (23, 23') forming an obtuse angle (α) with the upper base (22).

11 Claims, 2 Drawing Sheets

ONE-PIECE INNER NOZZLE AND CLAMPING DEVICE FOR HOLDING SUCH A NOZZLE

FIELD OF THE INVENTION

The present invention relates to a particular inner nozzle adapted to be used with a clamping device for an inner nozzle of a metallurgical vessel and to this new device.

BACKGROUND OF THE INVENTION

It is known that continuous casting of a liquid metal is generally carried out by means of an installation comprising various refractory components forming a channel between two successive metallurgical vessels. These components perform various functions, namely conveyance of the liquid metal, protection of the liquid metal against cooling and chemical attack from the surrounding atmosphere and, where appropriate, regulation of the pouring flow-rate of the liquid metal. These components may be, for example, an inner nozzle generally supported on a well block integral with the bottom of the upper metallurgical vessel, a submerged entry nozzle or a pouring shroud, a collector nozzle, or the fixed or mobile plates of a slide valve.

In recent years, considerable effort has been deployed in an attempt to achieve maximum simplicity of the various refractory components forming the pouring channel. Thus, with a view to reducing the number of joint surfaces between refractory components (all of which are points of potential air ingress), increasingly frequent use has for example been made of pre-assembled components or components formed from a single block, constituting the inner nozzle and the fixed upper plate located just below the inner nozzle and against which is placed either the mobile plate of a slide valve or the plate of a replaceable submerged entry nozzle (which may form an assembly with the submerged entry nozzle or forming a one-piece component with the latter). Such one-piece components are described for example in international patent application WO 88/06500.

Various devices are known which make it possible either to regulate the pouring flowrate, or to introduce and replace the submerged entry nozzle without having to interrupt the casting operation, or even to combine these two operations. These devices can be divided into two categories: a first type wherein the fixed upper plate (whether or not forming a one-piece assembly with the inner nozzle) is pushed upward and retained in position by a device acting on its upper face (see for example U.S. Pat. No. 4,573,616). In general, the upward thrust is transmitted by the refractory components located downstream (mobile plate of a slide valve or plate of a submerged entry nozzle) which are themselves pushed upward, directly or otherwise, by various spring mechanisms. According to a second type of device, the fixed upper plate is pushed downward and retained in position by a fixed stop against which the lower surface of the fixed upper plate bears (see for example international patent application WO 91/03339). This fixed stop thus defines in an extremely precise manner a reference plane in which slides the mobile refractory component situated immediately downstream of the fixed upper plate (mobile plate of a slide valve or plate associated with a submerged entry nozzle). It is known that it is necessary to make a perfectly airtight connection between the different refractory components constituting the pouring channel; therefore, it is important that the pressure with which the lower components are pushed towards the fixed upper plate is constant and is capable of being defined with great precision. Given that the upward thrust on these components is realised by means of a spring-operated device, the relative height of these components is a parameter that can considerably influence the pressure. In devices of the first type, the dimensions of all the refractory components involved are very closely toleranced so that their relative height in the stacked assembly formed by them is precisely defined. In the second type of device, the dimensional tolerances, particularly of the fixed upper plate, no longer have any influence on the pressure exerted between the various refractory components because the reference plane against which the components located downstream bear is defined independently of the said plate. Consequently, this second type of device can theoretically accommodate fixed upper plates (whether or not forming a one-piece assembly with the inner nozzle) having substantially less strict and therefore less onerous dimensional tolerances.

In practice, however, mechanical solutions allowing the fixed upper plate to be pushed downward (against the fixed stop holding it in position) are not wholly compatible with the use of plates presenting unduly large dimensional irregularities. In particular, even if a certain tolerance can be accepted on the thickness, it is necessary for the upper surface of the fixed upper plate to be perfectly flat and parallel to the lower surface. One of the objects of the present invention is therefore to provide a clamping device for the fixed upper plate (whether or not forming a one-piece assembly with the inner nozzle) which accommodates fixed upper plates with wide dimensional tolerances.

Where use is made of a one-piece inner nozzle, it may also be no easy matter to dismantle the mechanisms referred to above when the pouring sequence is completed and when it is necessary to undertake dismantling to facilitate maintenance operations on the said mechanisms or to replace worn refractory components or to recondition the upper metallurgical vessel for the next sequence in which it will be engaged. In effect, a situation can arise at the end of the sequence in which liquid metal solidifies in the inner nozzle and binds the latter to the bottom of the upper metallurgical vessel. In the case of a fixed upper plate/inner nozzle assembly, this does not pose any real problem as all that is required is to separate these two components in order to remove the mechanism leaving the inner nozzle full in the bottom wall of the upper metallurgical vessel. With a one-piece inner nozzle, this is no longer possible because, as indicated above, the fixed upper plate is either held at the top (devices of the first type) or pushed downward (devices of the second type). In both cases, the presence of a device acting on the upper surface of the fixed plate prevents disengagement of the mechanism addition, the limited available space considerably impedes, or even prevents, operations to disassemble the retaining or downward-pushing device of the fixed upper plate.

SUMMARY OF THE INVENTION

The object of the present invention is precisely a novel clamping device for the inner nozzle wherein the latter is held securely and precisely in place in the well block, but which however allows simple and rapid disassembly of the clamping device. By virtue of this novel device, the flow regulation or tube-changing mechanism or the mechanism performing these two operations can very easily be detached from the tundish.

According to the invention, the clamping device includes at least two assemblies each composed of a clamp pivoting about an horizontal axis and fitted with a groove receiving a shoe generally cylindrical in shape incorporating a flat surface parallel to the axis of said cylinder, said shoe being capable of pivoting in the groove. The shoe is therefore arranged sliding or sliding just in the groove of the clamp.

By virtue of the presence of the pivoting shoe, the contact between the clamp and the surface of the inner nozzle bearing on said clamp is established automatically and without operator intervention with the flat of the shoe oriented in a plane parallel to an upper surface of the plate of the inner nozzle. This results in substantially improved clamping of the nozzle without generating large local stresses at the inner nozzle. It will also been noted that the clamping system according to the present invention is composed of several assemblies (clamp/shoe) which are totally independent of each other so that the clamping device is suitable for inner nozzles with very wide tolerances, and even where the dimensions (thickness) vary from one side to the other of its tubular section.

Preferably, the groove is generally cylindrical in shape and its axis is located at a distance at least greater than the radius of the said cylinder. In this way, the shoe is held in the groove and can only be removed via a lateral opening. In a highly preferred manner, the axis of the cylinder is situated at a distance very slightly greater (for example in the order of 1 to 10%) than the radius of said cylinder.

According to a preferred embodiment, the clamp incorporates a bore in a direction orthogonal to the axis of the groove, the bore lying flush with the surface of the groove, and the shoe incorporates a groove in a direction orthogonal to its axis and similar in size to the bore in the clamp, this groove being situated opposite the flat of the shoe. In this way, by introducing an element generally tubular in shape, like a key or a screw, through the clamp bore and shoe groove, lateral movement of the shoe in the clamp groove is prevented. In effect, such movement must preferably be avoided as it could result in the shoe falling whilst the mechanism is being handled. By the same token, the shoe is prevented from making a full rotational movement in the groove. In effect, it is preferable to avoid undue rotation of the shoe which, if the flat were to become accidentally positioned inside the groove, could no longer automatically adapt to the contact surface of the inner nozzle.

Contact between the clamp and the surface of the nozzle bearing on said clamp is made by the pivoting motion of the clamp about a horizontal axis. According to a preferred embodiment, the pivoting motion is induced by a cam of which the eccentric part engages in a slot in the pivoting clamp. When the cam moves forward in the slot, it forces the clamp to pivot and, simultaneously, causes the shoe to rotate inside the groove of said clamp so that it adapts to an upper surface of the plate of the inner nozzle.

Advantageously, the bearing face of the cam designed to make contact with the clamp is not parallel to the axis of rotation of the cam so that the shear or bending forces on said axis are reduced.

According to an embodiment of the invention, the clamp is held in position simply by the forces of friction between the cam and the slot in the clamp. According to this embodiment, the cam is forced into the clamp slot, for example by means of a mallet. As a variant, it is possible to provide means on the eccentric component to allow the fitting of a metal rod extending the cam sufficiently so that by operating the lever thus formed the cam can be forced into the slot. Removal of the cam to release the pivoting clamp is performed in reverse sequence.

The present invention also relates to a one-piece inner nozzle particularly adapted for use with such a clamping device. The term one-piece inner nozzle designates an inner nozzle/fixed upper plate assembly (this being the plate located immediately below the inner nozzle and against which is placed either the mobile plate of a slide valve or the plate of a replaceable submerged entry nozzle) formed from a single block. The one-piece inner nozzle according to the invention is thus composed of a tubular part defining a pouring channel and a flat part or plate providing contact with the downstream component of the pouring channel. The characteristic of the nozzle according to the invention is that the plate is generally shaped as a prism which can be defined by its polygon-shaped bases and the prismatic surface which they intersect perpendicularly, the said polygon-shaped bases comprising an upper base whose displacement within the prismatic surface defines the interface with the tubular part and a lower base parallel to the upper base and, on either side of the upper base, two sides forming an obtuse angle with the upper base.

This particular form of the one-piece inner nozzle is particularly advantageous for several reasons. Firstly, it allows very precise and rapid fixing of the inner nozzle. According to a particular embodiment of the invention, it is possible in effect to lock one of the clamps in the closed position and to slide the nozzle against this clamp, so that the pivoting shoe bears perfectly on the inclined surface of the nozzle and immobilises the latter in horizontal travel at a perfectly defined position. The opposite clamp can then be closed in order to complete the clamping of the nozzle without having to move the latter any further.

Another considerable advantage conferred by the original form of the one-piece nozzle is that the pivoting clamps fold away automatically without requiring human intervention during disassembly of the tube-changer or regulating device. After loosening the clamps (for example by disengaging the cams), it is sufficient to lower the said device and the clamps simply move apart by pivoting on their axis. It may be readily understood that such an effect could not be obtained with a one-piece inner nozzle in which the upper surface of the plate is perfectly horizontal. In this case the clamp would in effect have to pivot through a large angle in order to disengage from the plate and a considerable space would have to be provided between the plate and the bottom wall of the metallurgical vessel for this purpose. In any event, the distance between two successive metallurgical vessels is generally limited and such space is rarely available.

Furthermore, an additional advantage associated with the presence of the inclined surfaces of the plate of the inner nozzle is that the compressive forces exerted by the clamping device are oriented towards a region of the lower face of the plate of the inner nozzle localised around the pouring channel, this being an area in which it is indispensable to ensure the greatest possible airtight contact between the refractory elements. These compressive forces have the effect of reducing the appearance of cracks in this region or, if such cracks appear nonetheless, preventing them from widening or propagating.

The simplest polygon corresponding to the definition given above is a trapezium. However, it is generally preferred to avoid sharp edges which can break easily. Therefore, according to a preferred form of the invention, the polygonal bases include at least two additional sides such that the polygons do not have any sharp angles. Preferably, these additional sides are substantially perpendicular to the lower base so that the inner nozzle can simply slide up to the stop designed to hold it vertically and so that it bears on the latter with the maximum available surface area.

According to another embodiment, the edges corresponding to the upper bases of each of the polygonal bases of the prism are also truncated. In this way, it is possible to clamp the inner nozzle with four pivoting clamps, which is advantageous in that any relative movement between the inner nozzle and the mechanism is avoided. In this embodiment, the plate can be represented by a parallelepiped surmounted by a pyramid with a square or rectangular base truncated on a plane parallel to its base. However, for reasons of convenience, the shape of this type of plate will be referred by the general term prism (with truncated edges).

Advantageously, the plate of the inner nozzle is not symmetrical so that there is only one clamping position of the nozzle against the mechanism. The fact that there is only one clamping position is particularly advantageous when the inner nozzle has to be connected to a gas delivery system or system for the injection of a sealing agent in a carrier fluid as described for example in international patent applications WO 98/17420 and WO 98/17421. This non-symmetry of the plate of the inner nozzle can be achieved for example by using a plate generally shaped as a prism of which the polygonal bases are irregular polygons. However, according to a preferred form, the non-symmetry of the plate is achieved by modifying the form of its corners, for example by truncating them or making them rounded in shape. Advantageously, the non-symmetry of the plate is realised by the fact the corners of the plate are rounded with a different radius of curvature for each pair.

Furthermore, it will be noted that the combination of the clamping device and the one-piece inner nozzle described above, by virtue of their cooperative action, affords a particularly important advantage. In effect, it has hitherto invariably been considered indispensable to fit one-piece inner nozzles with a metal jacket or casing. Firstly, the metal casing facilitates distribution of the stresses imposed by the clamping devices over a larger surface area, thereby avoiding the generation of localised stresses in the refractory material, and secondly by using prefabricated casings of precise dimensions it is possible to some extent to take up certain tolerances. However, the presence of this casing is not desirable in that it entails additional production costs (the casing itself, fitting, usage of cement, etc.).

By virtue of the present invention, it is possible to use one-piece inner nozzles unaccompanied by such a protective casing. In fact, it has been found that the presence of the flat on the self-adjusting pivoting shoe allows a surface-type contact to be established between the plate and clamp in all cases. Therefore, the function of the casing as a tundish of stresses is no longer required. Similarly, the clamping device permits the use of refractory components having much wider dimensional tolerances. Therefore, the function of the casing in taking up certain tolerances is no longer required To facilitate a better understanding of the invention, it will now be described with reference to the figures illustrating particular embodiments of the invention, without however limiting the invention in any way.

DETAILED DESCRIPTION OF THE INVENTION

Figure 1:
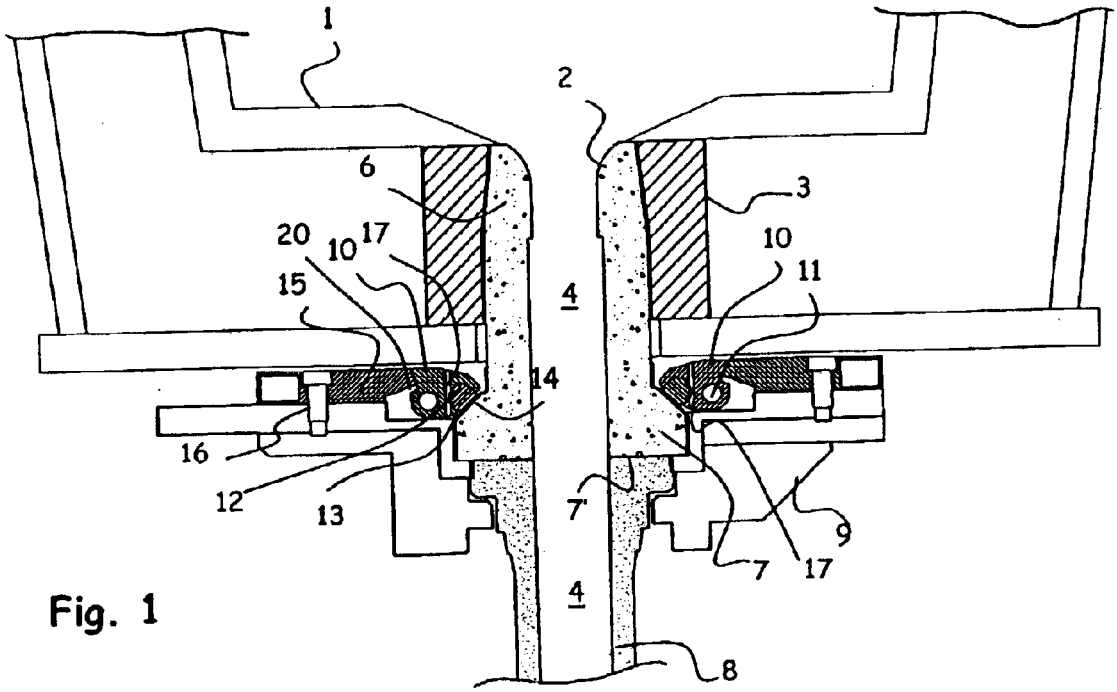
FIG. 1 shows a transverse cross-section of a tube changing mechanism fixed under the bottom of a continuous casting tundish incorporating the inner nozzle clamping device according to the present invention.
Figure 2:
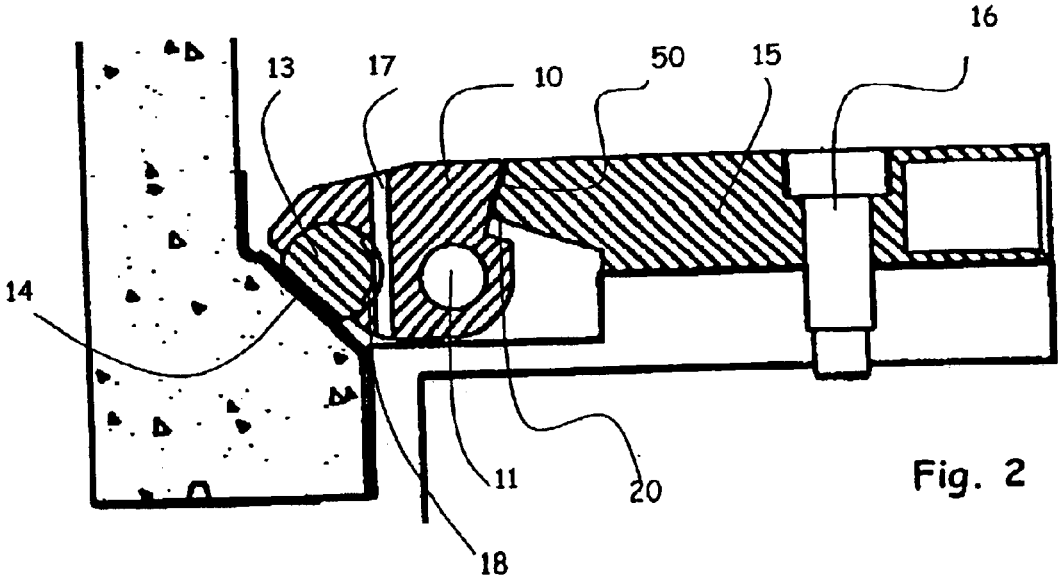
FIG. 2 shows an enlarged view of FIG. 1 showing the details of the clamping device.

In FIGS. 1 and 2, the bottom wall 1 of a tundish (not shown) is illustrated, penetrated by a one-piece inner nozzle 2 supported in a well block 3 and forming a channel 4 for the pouring of liquid metal into a continuous casting mould or ingot mould (not shown). Although this is not always the case, the lower part of the inner nozzle 2 may be fitted with a metal casing 5 (see FIG. 4). The inner nozzle 2 is composed of a tubular part 6 and a plate 7 of which the lower face 7' provides a contact surface with the downstream component 8 of the pouring channel 4. In this case, the component directly downstream of the inner nozzle is a submerged entry nozzle 8 whose lower end is inserted into the liquid metal bath at the ingot mould.

A tube-changing device 9 is also shown diagrammatically, which is used to replace a worn submerged entry nozzle 8 by a new submerged entry nozzle without having to interrupt the casting operations. The inner nozzle 2 is held in position and clamped relative to the tube-changing device 9 by means of a clamping device including a clamp 10 pivoting about a horizontal axis 11. The pivoting clamp 10 incorporates a groove 12 able to receive a shoe 13 capable of performing, at least partially, a rotational movement in the groove 12. The pivoting shoe 13 incorporates a flat surface 14. When the clamp moves to the closed position, the pivoting shoe 13 thus performs a rotational movement in the groove 12 so that the flat 14 of the shoe assumes an orientation in a plane parallel to the upper surface of the plate 7 of the inner nozzle. The clamp 10 moves into the clamped position under the effect of rotation of a cam 15 pivoting about a vertical axis 16. The inclined end 50 of the eccentric part of the cam 15 engages in a slot 20 in the clamp 10 and causes the latter to tilt as it moves along the slot 20.

Also illustrated is a bore 17 in the clamp 10 flush with the surface of the groove 12. A groove 18 in the pivoting shoe 13 is also shown. The insertion of a key 19 (not shown) into the bore 17 and groove 18 prevents translational motion and reduces rotation of the pivoting shoe 13 in the groove 12.

Figure 3:
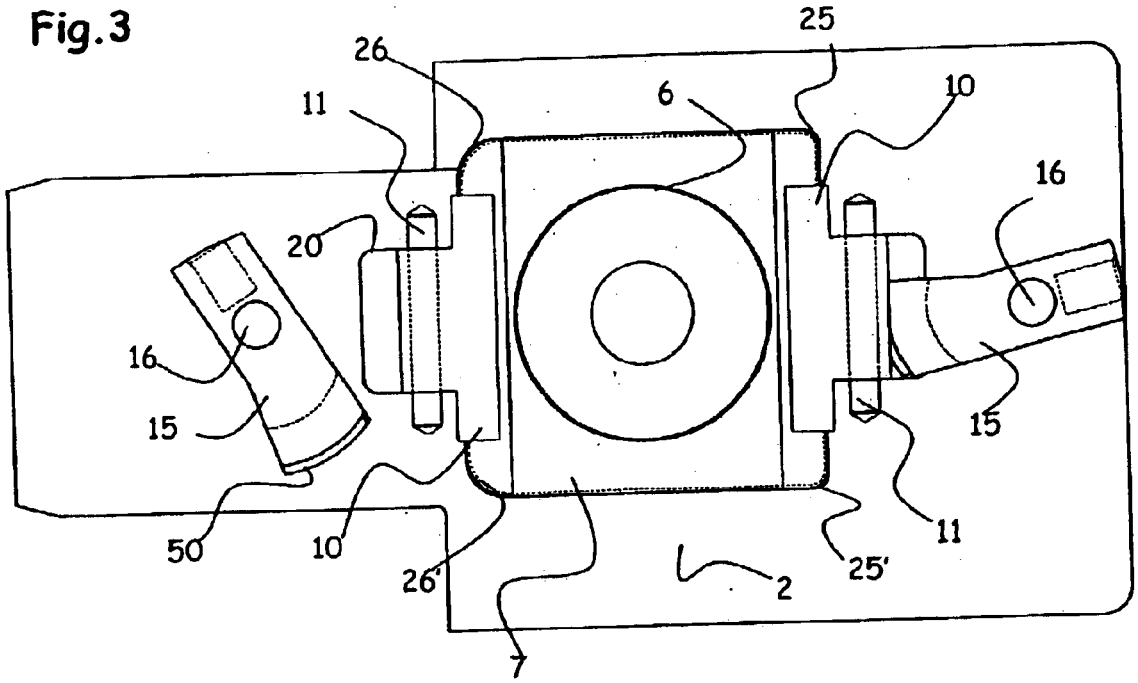
FIG. 3 shows a top view on the clamping device.

FIG. 3 provides a better understanding of the clamping device itself. This figure shows the plate 7 of the inner nozzle 2 in contact with the two clamps 10 pivoting about the horizontal axes 11 located on either side of the nozzle 2. The groove 12 and the pivoting shoe 13 are not visible in this figure. Under the effect of a rotational movement, about its axis 16, of the cam 15 (of which the bearing face 50 on the clamp 10 is inclined in relation to the axis 16) engaging in the slot 20 of the clamp 10, the latter is forced to tilt so that the shoe 13 pivots in the groove 12 and bears firmly against an upper surface of the plate 7 of the inner nozzle.

Figure 4:
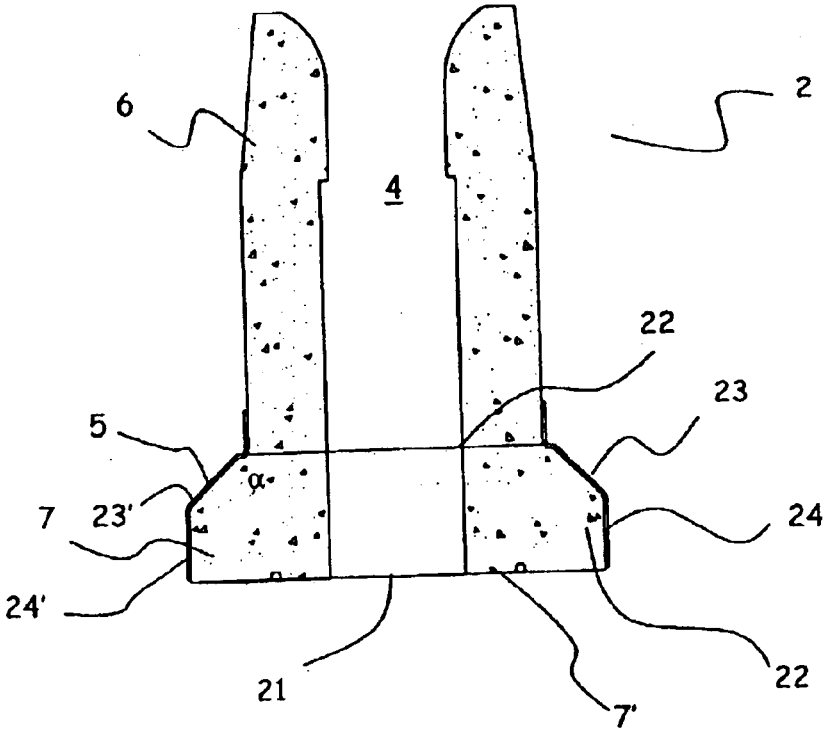
FIG. 4 respectively shows an axial sectional view of an inner nozzle according to the invention.

FIG. 4 shows a one-piece inner nozzle 2 including a tubular part 6 and a plate 7. The lower part of the nozzle is enclosed in a metal casing 5. This figure shows a view directly on one of the polygonal bases of the prism generally defining the plate 7. This polygon includes a lower base 21 (on which the lines of the prismatic surface bearing thereon form the lower face 7' of the plate), an upper base 22 parallel to the lower base 21 (on which the lines of the prismatic surface bearing thereon form a plane intercepting the junction between the lower end of the tubular part 6 and the upper part of the plate 7) and, on either side of the upper base, two sides (23, 23') forming an obtuse angle ($\alpha$) with the upper base (on which the lines of the prismatic surface bearing thereon form the the surface of the plate against which the pivoting shoes 13 of the clamp 10 are brought to bear). To avoid the presence of sharp edges (angle $\alpha$), the lower base 21 is connected to the inclined sides 23, 23' by means of intermediate sides 24, 24' substantially perpendicular to the lower base 21.

FIG. 3 also illustrated the nozzle 2 on which the tubular part 6 and the plate 7 are shown. The corners 25, 25' are rounded with a radius of curvature different from the radius of curvature of the rounded corners 26, 26' so that there is only one position in which the nozzle 2 can be mounted in the bottom wall 1 of the tundish.

| References: | |
|---|---|
| 1. | Tundish bottom wall |
| 2. | Inner nozzle |
| 3. | Well block |
| 4. | Pouring channel |
| 5. | Metal casing |
| 6. | Tubular part |
| 7. | Plate |
| 7'. | Lower face of plate |
| 8. | Submerged entry nozzle |
| 9. | Tube changing mechanism |
| 10. | Clamp |
| 11. | Clamp pivoting axis |
| 12. | Clamp groove |
| 13. | Pivoting shoe |
| 14. | Shoe flat |
| 15. | Cam |
| 16. | Cam pivoting axis |
| 17. | Clamp bore |
| 18. | Shoe groove |
| 19. | Key |
| 20. | Clamp slot |
| 21. | Lower base |
| 22. | Upper base |
| 23, 23'. | Inclined sides |
| 24, 24'. | Intermediate sides |
| 25, 25', 26, 26'. | Corners of plate |
| 50. | Inclined end of cam |

What is claimed is:

1. A one-piece inner nozzle comprising:

a) a tubular part comprising an upstream end and a downstream end fluidly connected by an first inner surface defining a first pouring channel; and b) a plate comprising a second inner surface defining a second pouring channel, the plate contacting the downstream end of the tubular part, whereby the second pouring channel is fluidly connected to the first pouring channel, the plate comprising a polygonal-shaped upper base having two opposite edges, a polygonal-shaped lower base parallel to the upper base, and a plurality of sides connecting the upper and lower bases, the sides including slanted facets forming an obtuse angle with the opposite edges of the upper base.

2. The nozzle of claim 1, wherein the plate comprises at least two additional facets between the slanted facets and the lower base, whereby the slanted facets do not intersect the lower base.

3. The nozzle of claim 1, wherein adjacent sides intersect at a corner and the corner is truncated.

4. The nozzle of claim 1, wherein the plate is asymmetrical.

5. The nozzle of claim 3, wherein the truncated corners are asymmetric.

6. The nozzle of 5, wherein the truncated corners are rounded asymmetrically with at least two different radii of curvature.

7. A clamping device for an inner nozzle defining a pouring channel having a pouring axis, the device comprising at least two assemblies on opposite sides of the inner nozzle, each assembly comprising a clamp capable of pivoting about a pivoting axis perpendicular to the pouring axis, each clamp having a depressed surface defining a groove, a show cooperating with the groove and comprising a generally cylindrical shape incorporating a flat surface substantially parallel to a long axis of the cylinder, whereby the shoe is capable of pivoting in the groove.

8. The clamping device of claim 7, wherein the long axis is located at a first distance from the pouring axis, and the groove includes a grooved axis parallel to the long axis and located at a second distance from the pouring axis greater than the first distance.

9. The clamping device of claim 7, wherein the clamp comprises an interior surface defining a bore substantially parallel to the pouring axis and tangentially intersecting the groove, the shoe defining a key slot substantially opposite the flat surface, parallel to the long axis and comparable in size to the bore, whereby a key inserted into the bore cooperates with the key slot to reduce rotation of the shoe relative to the groove.

10. The clamping device of claim 7, whereby the device comprises an eccentric cam having an inclined end adapted to pivot about a pivot axis that is substantially parallel to the pouring axis, and the inclined end engages a tilting slot whereby the clamp tilts as the inclined edge moves along the tilting slot.

11. An assembly for casting molten metal from an upstream metallurgical vessel to a downstream receptor comprising:

a) a one-piece inner nozzle comprising an upstream tubular part fixedly secured to a downstream plate, the nozzle having an inner surface defining a pouring channel with a pouring axis, the plate comprising a polygonal-shaped upper base having two opposite edges, a polygonal-shaped lower base parallel to the upper base, and a plurality of sides connecting the upper and lower bases, the sides including slanted facets forming an obtuse angle with the opposite edges of the upper base; and b) a device comprising at least two assemblies cooperating with the opposite edges of the inner nozzle, each assembly comprising a clamp capable of pivoting about a pivoting axis perpendicular to the pouring axis, each clamp having a depressed surface defining a groove, a shoe cooperating with the groove and comprising a generally cylindrical shape incorporating a flat surface substantially parallel to a long axis of the cylinder, whereby the shoe is capable of pivoting in the groove so as to secure the inner nozzle within the assembly.

* * * * *